United States Patent [19]

Davis et al.

[11] 4,447,307

[45] May 8, 1984

[54] ELECTROWINNING CELL HAVING PARTIALLY SHIELDED ANODES

[76] Inventors: Larry A. Davis, Box 1047, Kearny, Ariz. 85237; Gregory H. Boyce, 6114 E. Hannibal St., Mesa, Ariz. 85205; Timothy P. Mulloy, Box 1484, Kearny, Ariz. 85237; Neil J. Nebeker, Box 969, Kearny, Ariz. 85237; Elmer C. Newman, Box 1484, Kearny, Ariz. 85237; Donald J. Quinn, Queen Valley, Apache Junction, Ariz. 85220; David L. Adamson, 5839 Stanida Cir., Salt Lake City, Utah 84121

[21] Appl. No.: 450,136

[22] Filed: Dec. 15, 1982

[51] Int. Cl.[3] ..... C25C 7/00; C25D 17/06

[52] U.S. Cl. ..... 204/267; 204/DIG. 7; 204/279; 204/286

[58] Field of Search ..... 204/267–270, 204/286–289, 290 R, 279, DIG. 7, 242

[56] References Cited

U.S. PATENT DOCUMENTS 1,574,446 2/1926 Robinson ..... 204/267 X
2,833,710 5/1958 Mielke ..... 204/286
3,331,763 7/1967 Mabey ..... 204/290 R

FOREIGN PATENT DOCUMENTS 674230 11/1963 Canada ..... 204/290 R

*Primary Examiner*—Donald R. Valentine
*Attorney, Agent, or Firm*—Mallinckrodt, Mallinckrodt, Russell & Osburn

[57] ABSTRACT

An electrowinning cell has anodes shielded by an electrical-flux-impervious, electrically non-conductive material which protectively covers each of the anode suspension members and adjoining upper margins of the main body of the anodes. At least one electrical-flux-pervious opening of proper shape, size, and appropriate position to permit sufficient current flux to flow to an associated cathode to induce a uniform current distribution on the upper portions of the cathode is provided for each suspension member. The resulting uniform current distribution insures deposition of highly pure metal values of uniform thickness without the usual undesirable extraneous formations on the top edge of the electrowon metal cathode. The shielding material may be applied to an anode before attachment to its hangerbar for suspension in an electrowinning cell or may be applied to an anode which is already in service.

11 Claims, 5 Drawing Figures

ELECTROWINNING CELL HAVING PARTIALLY SHIELDED ANODES

BACKGROUND OF THE INVENTION

1. Field: The invention relates to the electrowinning of metal values from electrolyte solutions in electrolytic cells and to the construction of such cells.

2. State of the Art: In the electrowinning of metal values from solutions carrying such values, e.g. copper, nickel, or lead, the metal to be won deposits on a cathode starter sheet, and the quality of the deposition, both in chemical composition and physical shape, is of great concern. It is desirable to obtain a metal deposition of sufficient quality that it may be marketed directly to the consumer of the metal or used for other purposes without further refining and processing.

In an electrowinning cell, uneven current distribution upon the surface of the anode results in a corresponding uneven current distribution upon the surface of the cathode which causes the metal to deposit upon the cathode in non-uniform thickness and irregular formations. The irregular formations, or "mushroom-like growths" as they are sometimes called, cause serious problems in handling and subsequent processing of the metal cathode.

The formations usually appear along the edges and loops of the cathode, where the current distribution is high compared to other electro-active surfaces of the cathode where the current distribution is low and uniform. Since the rate of metal deposition is much greater in areas of high current distribution, the formations appear and develop into large masses at a higher rate of deposition than the rate of metal deposition on low current distribution areas. The formations increase so rapidly in size that, soon after the start of electrowinning, they touch the anode and cause extensive electrical shorting between the anode and cathode, reducing the current efficiency of the electrolytic cell and eventually stopping electrowinning altogether. Thus, the marketable product, namely, the metal cathode, is limited in thickness proportionate to the amount of time of the electrowinning. To deposit all of the metal values in a typical leach or solvent extraction electrolyte, the cathode starting sheets must be replaced several times.

In electrowinning, impurities in the electrolyte either remain in solution or settle to the bottom of the electrolytic cell in the form of a mud. The undesirable metal formations, which are deposited at the cathode, trap significant quantities of these impurities, typically lead and sulfur, electrolyte, stray solvent-extraction organic materials, and slime. As a result of these trapped materials, the electrowon metal is not of sufficient quality for direct sale to the consumer, for semi-continuous cake casting, for rod casting, or for many other applications. In addition, the electrowon metal products are very difficult to stack, store, and transport, as they bundle poorly because of the differences in thickness caused by the formations. Thus, the electrowon metal product must undergo further refining and processing before final usefulness is achieved.

The only way to eliminate development of these undesirable formations is to achieve a uniform current distribution on the surface area of the cathode. Heretofore, uniform current distribution has been achieved on the front and back surfaces and on the side and bottom edges by cutting the anode slightly shorter and narrower than the cathode. Normally electrical current flowing into the anode will be unevenly distributed, with higher current distribution on the suspension lugs and on the top, side, and bottom edges of the anode than on the front and back surfaces. When the anode and cathode are of the same dimension, the electrical current flux from anode to cathode induces a corresponding uneven current distribution on the cathode. When the anode is slightly shorter and narrower than the cathode, the high density electrical flux from the side and bottom edges of the anode redistributes itself on the greater surface area of the cathode such that the current distribution on the front and back surfaces and on side and bottom edges of the cathode is even.

Particular types of electrowinning processes require particular types of electrodes. Often the material from which the anode and cathode must be made and the amount of electrical current that the electrodes must carry restrict the size and shape of the electrodes, particularly the top portions thereof which must include suspension members for hanging the electrode from a hanger bar. Such suspension members must be sufficiently conductive and strong to support the main body of the electrode. Because of these size and shape restrictions, uniform current distribution cannot always be obtained along top areas of the cathode. This is true also because frequently the anode must be larger than the cathode in these upper areas.

No practical solutions for the problem of obtaining a uniform current distribution in such areas of the cathode are available in the prior art. In electrode pairs where this situation occurs, producers of electrowon metal have to settle either for metal depositions with undesirable extraneous formations on the top edge or for undesirably thin depositions.

SUMMARY OF THE INVENTION

1. Objectives: In the making of the invention, it was an objective to provide an electrowinning cell in which the current distribution on a cathode would be uniform and would produce an electrowon metal product of high quality, both in chemical composition and physical shape, such that it would be directly marketable or usable for other purposes without further refining or processing. It was a further objective to provide both an anode and an anode shield as articles of manufacture which could be used to convert existing electrolytic cells to conform, or in the construction of new electrolytic cells conforming, to the invention.

2. Features: In the accomplishment of the foregoing objective of the invention, each anode of an anode-cathode pair having broad-area suspension members has its suspension member or members and the adjacent upper margin of the main body of the anode shielded by an electrical-flux-impervious, electrically non-conductive material resistant to the corrosive properties of the electrolyte of the electrowinning cell, such as a polyvinylchloride (PVC) plastic, there being at least one electrical-flux-pervious, electrically conductive opening which is appropriately positioned in the shielding material and of proper shape and size to permit sufficient current flux to flow to the cathode to induce a uniform current distribution on the upper portions of the cathode.

The shielding material may be applied to the anode before attachment of such anode to its suspension bar, or may be applied to anodes already suspended in an electrowinning cell. In either case, it is a feature of the invention to produce a shield of shape-retaining material, such as an appropriate grade of a PVC plastic, as an article of manufacture. For application to an anode already suspended in an electrowinning cell, the shield is made in two half sections provided with mating fastening members so as to snap together about the portion of the anode to be shielded.

THE DRAWINGS

The best mode presently contemplated for carrying out the invention is shown in the accompanying drawings, in which:

FIG. 1 is a cut-away perspective view of an electrowinning cell utilizing a suspended anode-cathode system showing the invention in place on the suspension members of the anode and its spacial relationship to the cathodes in an anode-cathode pair;

FIG. 2, a vertical section taken on the line 2—2 of FIG. 1;

FIG. 3, a front elevation of an anode with shields in place;

FIG. 4, a perspective of a shield alone; and

FIG. 5, an exploded view of the two halves of the shield in perspective.

DETAILED DESCRIPTION OF THE ILLUSTRATED EMBODIMENT

Figure 4:
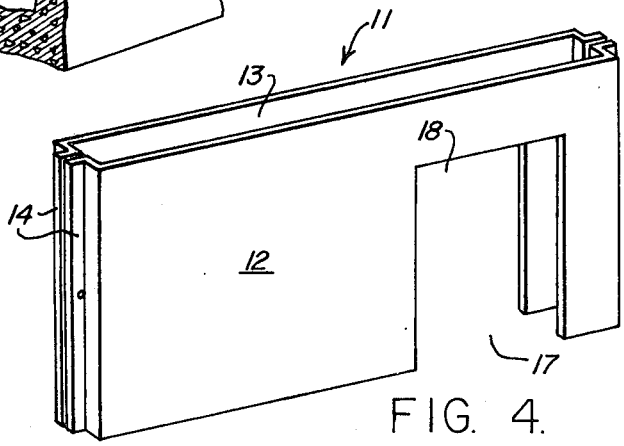

In the form illustrated, an anode shield 11 is constructed of a semi-rigid, electrical-flux-impervious, electrically non-conductive, electrolyte resistant material, such as polyvinylchloride (PVC) plastic, appropriately shaped, such as by injection molding, to fit about an anode suspension member 20. The assembled anode shield 11, FIG. 4, consists of two halves 12 and 13, FIG. 5, which are joined together by mating fastening members. The fastening members are preferably abutting flanges 14, joined by means of pins 15 which snap into receiving holes 16. The pins 15 and receiving holes 16 preferably alternate along the length of the flanges, as shown, but one flange may have all pins and the other mating flange all receiving holes. The pins 15 may fit into holes 16 with a friction or other type of fit sufficient to hold halves 12 and 13 together, or an adhesive may be used to secure the pins in the holes or to otherwise secure the halves together.

Figure 1:
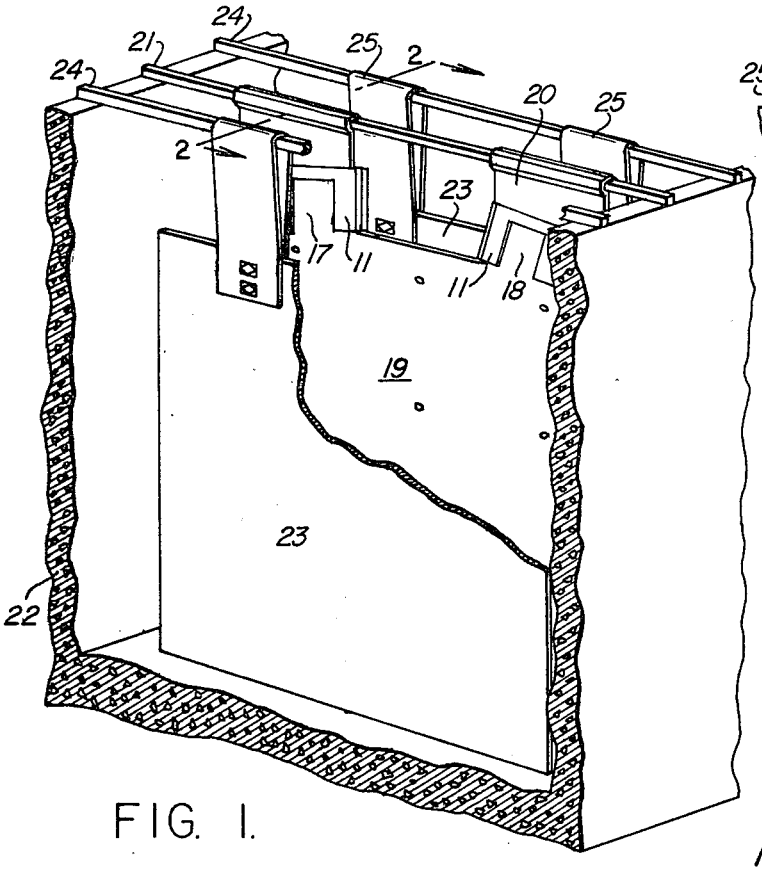
Figure 2:
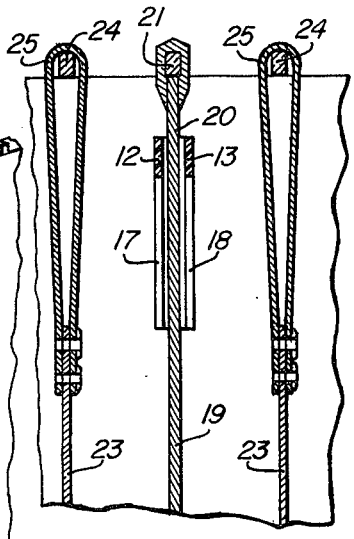
Figure 3:
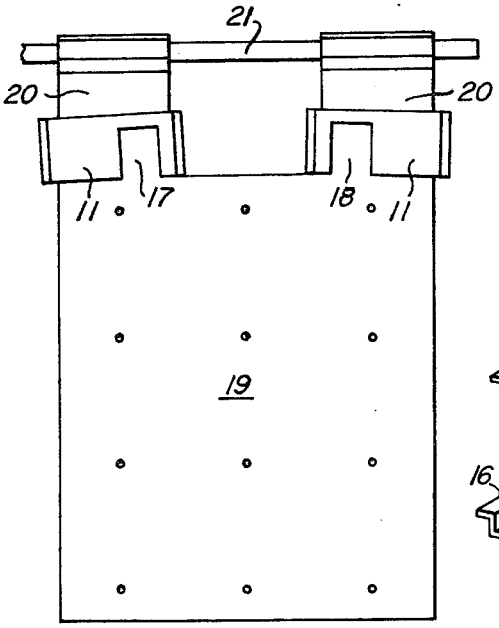

The anode of an electrowinning cell typically consists of a main body 19, FIGS. 2 and 3, which is suspended from an anode hanger bar 21, FIG. 3, by anode suspension members 20 which are typically cast integrally with the main anode body and are called lugs. The shields 11 are located on the respective anode suspension members 20 to form electrical flux barriers about such members adjoining portions of the upper margin of the main anode body 19. The cathode of an electrowinning cell typically consists of a cathode starter sheet 23, FIGS. 1 and 2, which is suspended from a cathode hanger bar 24 by cathode suspension members 25, typically called loops. Normally, the anodes and cathodes alternate in an electrowinning tank so that each anode main body 19 hangs between two cathode main bodies 23, as shown. The combination of an anode with either one of the immediately adjacent cathodes is called an "anode-cathode pair".

Figure 5:
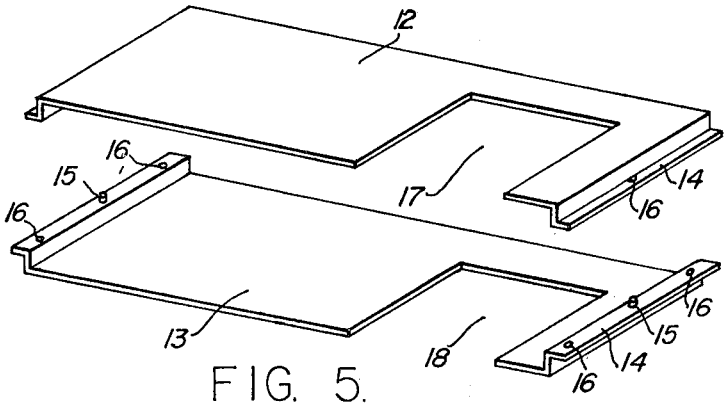

Each of the halves 12 and 13 of the anode shield 11 has at least one electrical-flux-previous, electrically-conductive opening provided therein, the one for half 12 being indicated 17, FIG. 5, and the one for half 13 being indicated 18. Preferably, these openings are notches formed upwardly from the bottom edges of the respective halves. In the illustrated embodiment, the notches 17 and 18 are located in their respective halves 12 and 13 such that the vertical centerline of the notch is approximately aligned with the vertical center line of the corresponding cathode suspension members 25, FIGS. 1 and 2. It should be understood, however, that the electrical-flux-pervious, electrically conductive openings may be of any shape and size and positioned anywhere within the shield so long as the openings are of sufficient shape, size, and position to allow enough electrical flux to flow to the upper portions of the cathode to result in uniform current distribution on such upper portions.

The invention is further described in connection with the following example, which is intended to illustrate the invention but not to limit the scope thereof.

EXAMPLE

The illustrated two piece embodiment of the invention has been tested in industrial electrowinning of copper metal values. Partial shields have been constructed of an appropriate grade of PVC plastic by injection molding to fit closely about the suspension members of two types of anodes which, before the addition of the partial shields, produced an electrowon-metal cathode that exhibited the undesirable extraneous formations on the top edge and undesirably thin copper depositions. One anode was a cast, calcium-containing, lead alloy anode similar to that described in U.S. Pat. No. 3,859,185, and the other type was a rolled, calcium-containing, lead alloy anode which also contained 0.9% tin in its composition. The suspension members of both types of anodes were approximately ten inches wide and nine inches high.

The cathode starter sheets associated with these anodes were 1/32 of an inch thick copper, and the attached cathode suspension members were 1/32 of an inch thick, six inch wide, copper straps. The inside edge of a cathode suspension member approximately aligned with the inside edge of the corresponding anode suspension member when the anode-cathode pairs were hung in the electrowinning cell.

The specific electrowinning process involved prior solvent extraction, and the electrolyte composition was approximately 170 grams/liter sulfuric acid, 45 grams/-liter copper, 50 parts per million cobalt, 30 parts per million chloride, and 2 grams per liter iron.

The shields were attached about the anode suspension members after they were attached to the hanger bar by gluing corresponding fastening members of the shield halves together with an appropriate PVC cement. The notch in each half of the shield was three inches wide and extended upwardly four inches from the bottom margin of the shield. The notches were positioned in their respective halves such that the vertical center line of the notch approximately aligned with the vertical center line of the corresponding cathode suspension member.

Copper values were electrowon at current density values of 22 and 12 amps/square foot. The resulting electrowon metal cathodes were of uniform deposition and of extremely high purity, typically 99.98% copper, with sulfur levels reduced from 40–120 ppm to below 10 ppm and lead from 10–20 ppm to below 2 ppm. The current efficiency of the electrowinning cell was 95 to 97 percent.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. In an electrowinning cell utilizing suspended anode-cathode pairs having broad-area suspension members extending upwardly from the main bodies of respective, mutually spaced anodes and cathodes wherein the anodes and the suspension members thereof are such as to cause uneven cathode-current distribution and irregular metal deposits on the suspension members and upper margins of the cathodes, the improvement comprising respective, partial, anode shields applied to and carried by respective anode suspension members adjacent to upper margins of the anode bodies, each of said partial anode shields comprising an electrical-flux-impervious, electrically non-conductive material protectively covering only that portion of a suspension member adjoining the upper margin of the main body of the anode and which is within the area of electrical flux, and each of said partial anode shields having at least one electrical-flux-pervious, electrically conductive opening which is appropriately positioned in the anode shield and is of proper shape and size to permit sufficient current flux to flow to the paired cathode, when suspended in an electrowinning cell of the type specified, to induce a uniform current distribution on the upper portions of the cathode.

2. An electrowinning cell in accordance with claim 1, wherein the electrical-flux-pervious, electrically conductive opening is a notch formed upwardly from the bottom edge of the electrical-flux-impervious, electrically non-conductive material at the face of the anode which is adjacent to a cathode and at a position in the anode shield such that the vertical centerline of said notch is approximately aligned with the vertical centerline of the corresponding suspension member of the cathode with which said anode will be associated, said notch being only large enough to permit sufficient current flux to flow to the cathode to induce a uniform current distribution on the upper portions of the cathode.

3. For use in electrowinning cells that utilize anode-cathode pairs having broad-area suspension members extending upwardly from the main bodies of respective, mutually spaced anodes and cathodes, wherein the anodes and suspension members thereof are such as to cause uneven cathode-current distribution and irregular metal deposits on the suspension members and upper margins of the cathodes; an anode having at least one broad-area suspension member; and a partial anode shield applied to and carried by each said suspension member adjacent to the upper margin of the main body of the anode, said partial shield comprising an electrical-flux-impervious, electrically non-conductive material protectively covering only that portion of the suspension member adjoining the upper margin of the main body of said anode and which will be within the area of electrical flux when the anode is suspended in an electrowinning cell, each of said partial anode shields having at least one electrical-flux-pervious, electrically conductive opening which is appropriately positioned in the shield and is of proper shape and size to permit sufficient current flux to flow to a paired cathode, when said anode is suspended in an electrowinning cell of the type specified, to induce a uniform current distribution on the upper portions of the cathode.

4. An anode in accordance with claim 3, wherein the electrical-flux-pervious, electrically conductive opening is a notch formed upwardly from the bottom edge of the electrical-flux-impervious, electrically non-conductive material at the face of the anode which will be adjacent to a cathode and at a position in the shield, when suspended in an electrowinning cell as specified, such that the vertical center line of said notch is approximately aligned with the vertical centerline of the corresponding suspension member of the cathode with which said anode is associated in said cell, said notch being only large enough to permit sufficient current flux to flow to the cathode to induce a uniform current distribution on the upper portions of the cathode.

5. As an article of manufacture, a partial shield for mounting on an anode of an electrowinning cell that utilizes anode-cathode pairs having broad-area suspension members extending upwardly from the main bodies of the respective anodes and cathodes, wherein the anodes and suspension members thereof are such as to cause uneven cathode-current distribution and irregular metal deposits on the suspension members and upper margins of the cathodes, said partial shield comprising shape-retaining, electrical-flux-impervious, electrically non-conductive material forming mutually spaced and opposite, substantially coextensive, broad-area front and rear walls and relatively narrow, lateral end walls for enclosing an anode suspension member and its adjoining margin of the main body of the anode; and having at least one electrical-flux-pervious, electrically conductive opening which is appropriately positioned in the shield and is of proper shape and size to permit sufficient current flux to flow to the cathode, when applied to an anode in an electrowinning cell as specified, to induce a uniform current distribution on the upper portions of the cathode.

6. An article of manufacture in accordance with claim 5, wherein the electrical-flux-pervious electrically conductive opening is a notch formed upwardly from the bottom edge of said wall of said shield adjacent to a cathode and at a position such that the vertical centerline of said opening will be approximately aligned with the vertical centerline of the corresponding suspension members of the cathodes with which said anode will be associated in an electrowinning cell as specified, said notch being only large enough to permit sufficient current flux to flow to the cathode to induce a uniform current distribution on the upper portions of the cathode.

7. An article of manufacture in accordance with claim 5, wherein the shield is constructed of an appropriate grade of polyvinylchloride (PVC) plastic.

8. An article of manufacture in accordance with claim 5, wherein the shield is an injection molding.

9. An article of manufacture in accordance with claim 5, wherein the shield is of one piece construction and is mounted on the anode suspension member before said suspension member is attached to the anode hanger bar.

10. An article of manufacture in accordance with claim 5, wherein the shield is constructed of at least two pieces, which have mating fastening members securing them together, and which may be mounted on the anode suspension member after said suspension member is attached to the anode hanger bar.

11. An article of manufacture in accordance with claim 10, wherein the mating fastening members comprise abutting flanges joined by pins snapped into corresponding receiving holes.

* * * * *

UNITED STATES PATENT AND TRADEMARK OFFICE

CERTIFICATE OF CORRECTION

PATENT NO. : 4,447,307

DATED : May 8, 1984

INVENTOR(S) : Davis et al.

It is certified that error appears in the above-identified patent and that said Letters Patent is hereby corrected as shown below:

On the title page add:

-- /73/ Assignee:
Kennecott Corporation,
a New York corporation

Salt Lake City, Utah --.

Signed and Sealed this

Thirtieth Day of October 1984

[SEAL]

*Attest:*

GERALD J. MOSSINGHOFF

*Attesting Officer*

*Commissioner of Patents and Trademarks*